United States Patent [19]

Mäkelä et al.

[11] Patent Number: 4,487,219

[45] Date of Patent: Dec. 11, 1984

[54] FLOOR DRAIN OR SOME OTHER CUPPED WATER SEAL

[75] Inventors: Paavo Mäkelä, Helsinki; Kalervo Männistö, Vantaa; Heikki Masalin, Espoo, all of Finland

[73] Assignee: Oy All-Plast Ab, Helsinki, Finland

[21] Appl. No.: 492,941

[22] Filed: May 9, 1983

[30] Foreign Application Priority Data

May 13, 1982 [FI] Finland ..... 821689

[51] Int. Cl.[3] ..... F16L 5/00; F16K 9/00

[52] U.S. Cl. ..... 137/362; 137/247.45; 137/247.47

[58] Field of Search ..... 137/362, 357, 247.35, 137/247.41, 247.43, 247.45, 247.47

[56] References Cited

U.S. PATENT DOCUMENTS 558,569 4/1896 Sanders ..... 137/247.35
1,109,740 9/1914 Dehn ..... 137/362
4,098,287 7/1978 Baumbach ..... 137/362
4,212,314 7/1980 Ericson ..... 137/362

FOREIGN PATENT DOCUMENTS 18917 9/1887 Italy ..... 137/247.37

*Primary Examiner*—A. Michael Chambers
*Attorney, Agent, or Firm*—Owen, Wickersham & Erickson

[57] ABSTRACT

A floor drain or some other cup-shaped water seal, comprising a cupped body (1), a superstructure including a trash screen (2), a water seal forming wall (3), and an outlet (4) for a sewer pipe (5). A problem is to improve the superstructure of a floor drain so as to prevent bacteria from spreading out along moist surface films or membranes. In order to resolve the problem, the superstructure is provided with a funnel-shaped ring (6), which is fitted below trash screen (2) and whose central hole (7) is smaller than said outlet (4) and whose outer rim is tightly (8) sealed to body (1).

2 Claims, 1 Drawing Figure

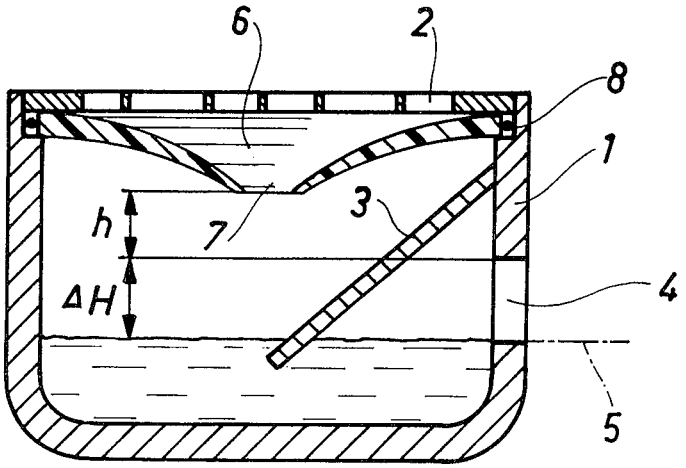
6
2
8
1
3
h
7
ΔH
4
5

FLOOR DRAIN OR SOME OTHER CUPPED WATER SEAL

The present invention relates to a floor drain or some other cupped water seal or drain trap, comprising a cupped body, a superstructure including a trash screen, a water seal forming wall, and an outlet for the sewer pipe.

The water seal of floor drains and other cupped drain traps is capable of effectively stopping the spreading of odours to the environment but it is incapable of preventing the spreading of sewerage bacteria along the moist surface films. The prior art floor drains are not capable of preventing direct and straight contact between the water flooding on a floor and the sewage water.

An object of the invention is to provide a superstructure for a floor drain or some other cupped water seal improved as effectively as possible to prevent the spreading of sewage bacteria to the environment.

This object is accomplished by means of a floor drain according to the invention on the basis of the characterizing features set forth in the annexed claim 1.

The invention will now be described with reference made to the accompanying drawing which shows a floor drain according to one embodiment of the invention in vertical cross-section.

The floor drain comprises a cupped body 1 whose inlet is covered by a trash screen 2. Body 1 is provided with an outlet 4 for a sewer pipe 5. Pipe 5 can be fitted in outlet 4 e.g. by means of a thread or, alternatively, body 1 is fitted with a connecting pipe stub to which the sewer pipe can be connected. Inside said body cup 1 is provided a wall 3 which, when extending below the lower edge of outlet 4 forms a water seal.

In conventional floor drains, considerably larger amounts of water can flow through screen 2 than those admitted out through port 4. Thus, the water level rises up to screen 2 and thereabove on a floor surface. The walls of cup 1 make up a continuous moist film up to the floor surface. Along such a film or membrane the sewage bacteria have been able spread in large amounts on floor surfaces.

In the present invention, this problem is eliminated by fitting below said screen 2 a funnel-shaped ring 6 whose central hole 7 is smaller than outlet 4. Thus, the funnel ring 6 and the size of hole 7 limit the amount of water arriving in cup 1 in a manner that the water level cannot rise above the upper rim of port 4. Hence, the water level in cup 1 varies within the range $\Delta H$. The rims of the central port 7 of said funnel ring 6 lie a substantially distance h above the upper rim of outlet 4. The lower surface of funnel ring 6 provides a substantially dry zone over which the bacteria would be forced to spread. In these conditions, however, the increasing and spreading of bacteria is considerably limited.

It is also of essential significant that the outer rim of funnel ring 6 is tightly fitted on body 1. This can be effected e.g. by means of an O-ring sealing 8. Thus, water cannot trickle along the inner surfaces of cup 1 and no moist membrane or film is formed between the water level in cup 1 and the floor.

Funnel ring is most preferably made of plastics whose surface tension entrains the water possibly splashed on the lower surface of ring 6, thus preventing the formation of a continuous water membrane.

The above description deals with the invention in connection with a floor drain but it should be appreciated that the invention is also applicable to cup-shaped water seals used in connection with basins. Examples of these are e.g. so-called bottle water seals.

We claim:

1. A cup-shaped water seal for a floor drain and the like, comprising

- a cup-shaped body (1) with a substantially vertical side wall and a bottom wall,
- a horizontal trash screen (2) at the top,
- an angularly extending water seal forming wall (3) extending downwardly and inwardly from said vertical wall and terminating above said bottom wall,
- an outlet (4) through said side wall lying entirely above the lower end of said water seal forming wall and shielded thereby, for connection to a sewer pipe (5),
- a funnel-shaped ring (6) below said trash screen (2) having an always-open central hole (7) substantially smaller than said outlet (4) and located entirely above said outlet (4) and whose outer rim is tightly (8) sealed to said body (1), the rims of the central hole (7) of the funnel-shaped ring (6) lying no lower than the upper rim of said outlet (4), so that water in said cup-shaped body does not rise above the upper rim of the outlet (4).

2. A floor drain as set forth in claim 1 characterized in that said funnel ring (6) is made of plastics.

* * * * *